United States Patent [19]

Martin

[11] Patent Number: 4,523,442

[45] Date of Patent: Jun. 18, 1985

[54] KEY-HOLDER

[75] Inventor: Jack Martin, Geneva, Switzerland

[73] Assignee: Attilio Brentini, Ecublens, Switzerland

[21] Appl. No.: 375,121

[22] PCT Filed: Aug. 28, 1981

[86] PCT No.: PCT/CH81/00098

§ 371 Date: Apr. 22, 1982

§ 102(e) Date: Apr. 22, 1982

[87] PCT Pub. No.: WO82/00751

PCT Pub. Date: Mar. 18, 1982

[30] Foreign Application Priority Data

Aug. 29, 1980 [FR] France ..... 80 18948

[51] Int. Cl.[3] ..... A47G 29/10

[52] U.S. Cl. ..... 70/459

[58] Field of Search ..... 70/456 R, 457, 458, 70/459; 150/37, 40; 24/3 K, 241 P, 241 PP, 241 SL; D3/61, 62

[56] References Cited

U.S. PATENT DOCUMENTS 755,473 3/1904 Erb ..... 70/459
2,361,506 10/1944 Smith ..... 70/458
2,816,434 12/1957 Olson ..... 70/458
2,924,088 2/1960 Goldman ..... 70/458

*Primary Examiner*—Robert L. Wolfe
*Attorney, Agent, or Firm*—Ladas & Parry

[57] ABSTRACT

A U-shaped part (1) of which the two parallel branches (1*a*, 1*b*) may slide in corresponding grooves (9*a*, 9*b*) of a casing, forms a key receiver ring. In a chamber (13) of the casing (2) there is provided a mechanism comprising an oscillating part (3) provided with a spring blade (11) and having a series of notches (14) forming latch locks. The free end of the longer branch (1*b*) of the U-shaped part (11) is provided with a bolt (4). A maneuver button (10) allows to oscillate the oscillating part (3) against the action of its spring (11) to disengage the bolt (4) of the latch lock (14) where the spring was keeping it engaged, thereby allowing to disengage from the casing (2) the shorter branch (1*a*) of the U and to bring the bolt (4) selectively facing one of the latch locks (14) so that the length of the portion of the ring (1) being outside the casing corresponds to the number of the keys engaged on that portion. By releasing the button (10), the spring (11) produces the cooperation between the bolt (4) and the latch lock (14) thereby locking the ring (1) on the casing (2).

8 Claims, 7 Drawing Figures

FIG. 1a
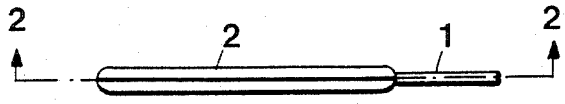
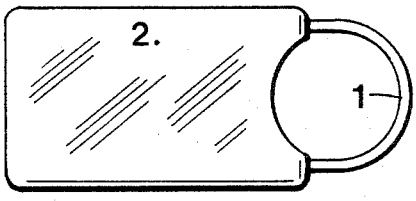
FIG. 1
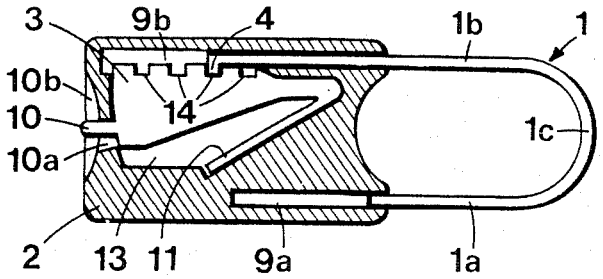
FIG. 2

KEY-HOLDER

The object of the present invention is to provide a key-holder comprising a device allowing to adjust the size of its ring which may vary according to the number of keys that are hooked therein, and preventing the inadvertent opening of the ring after it has been locked.

In the field of key-holders, the inventions of the prior comprise primarily spiral rings or half-rings bearing on a support, opening and closing only by the simple elasticity of the metal used for their construction.

Some systems which are more elaborate for opening and closing the ring comprise what follows:

Either a bracelet provided with an inner notch wherein one ring end worked as a catch comes in, the other ring end sliding in the bracelet; or hinged devices actuated by a small lateral force lever; or a serrated with a simple or reverse thread, arranged on an ovoidal ring of which both ends are threaded.

There is also a wall or mural key-holder comprising a foldable moving flap, after inserting the keys, on a panel fixed to the wall and provided with a spring clip which provides for the holding or releasing of the movable flap.

The object of the present invention is to provide the user with a key-holder allowing an easy insertion of an increasing or decreasing number of keys, owing to a ring of which the size may be varied and may be adjusted according to different positions and of which the locking and opening are effected by a mechanism incorporated in the body of the key-holder and which allows to give the desired size to the ring, as well as to prevent the inadvertent opening. The object of the present invention is a key-holder according to claim 1.

The attached drawings illustrate, by way of non-restrictive examples, two forms of executions and an alternative of the key-holder according to the invention.

FIG. 1 is a front view of the first form of execution.

FIG. 1*a* is a profile view corresponding to FIG. 1.

FIG. 2 is a cross-section view according to 2—2 of FIG. 1*a*, showing the inside of this form of execution.

Figure 3A:
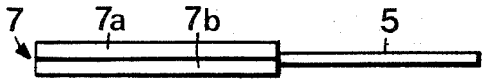
FIG. 3 is a diagrammatic front view of the second form of execution.
Figure 3:
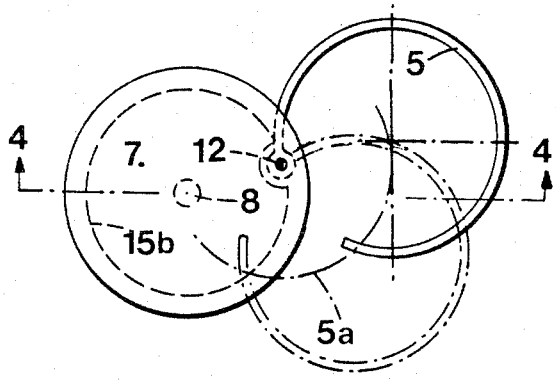

FIG. 3*a* is a profile view corresponding to FIG. 3.

Figure 4:
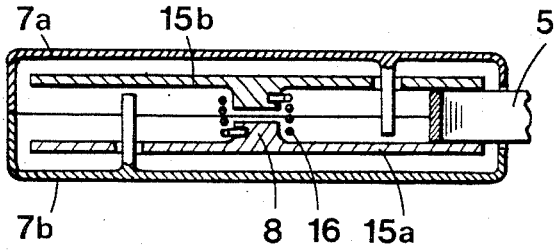

FIG. 4 is a partial cross-section view, on a larger scale, according to 4—4 of FIG. 3.

Figure 5:
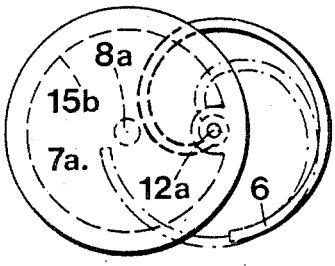

FIG. 5 is a view similar to FIG. 3 but showing an alternative of the second form of execution.

The first form of execution is formed, on one hand by a flat casing 2 comprised of two integral symmetric parts forming the body of the key-holder and, on the other hand, with a rod 1 made of metal or hard plastic material, having a U-shape of which the branches 1*a*, 1*b* are of unequal lengths whereas its intermediate portion 1*c* has the shape of a semi-circle. In the inside of the casing 2 there is arranged a mechanism, visible on FIG. 2, of which the function will be explained further. There are provided in the casing 2 two parallel grooves 9*a*, 9*b*, of unequal length, in which are engaged and may slide the branches 1*a*, 1*b*, respectively, of the part 1. The branch 1*b* is longer and is terminated by a catch 4 forming a bolt, as it will be further described. There is also provided in the casing 2 a chamber 13 wherein there is arranged an oscillating part 3 having the general shape of a triangle rectangle and having at its summit opposite to the right angle a curved portion 11 forming a blade spring. On its side opposite to that summit, the part 3 has an actuating button 10 traversing a slot 10*a* of the body 2 and projecting slightly outside the body, in a depression 10*b* of the latter.

The part 3 has on one of its sides a row of notches 14 forming latch locks and in each of which the bolt 4 may be engaged selectively, as it will be further described. The operaton of this form of execution is as follows. Starting from the position of the members represented on FIG. 3 where the spring blade 11 forces one of the notches 14 to cooperate with the bolt 4, if the actuating button 10 is operated from top to bottom on FIG. 3, the part 3 is lowered by oscillating about its right extremity and the notch or lock 14 wherein the bolt 4 was engaged, is detached from the latter and releases the bolt. Then, while the button 10 is kept in a lowered position, the branches 1*a*, 1*b* may slide in their respective grooves 9*a*, 9*b* and the short branch 1*a* may be disengaged from the casing, in order to add keys on the part 1 or remove keys from that part. Thereafter, the branches 1*a*, 1*b* are pushed into the casing 2, so that the portion of the part 1 remaining outside the casing forms a ring of a size appropriate to the number of keys carried by that portion and appropriate to the degree of handling freedom desired for the keys hooked to this ring. By releasing the finger 10, the portion 11 forming spring brings back the notches or locks 14 in an active position and the snug or bolt 4 engages the closest latch lock 14. At that time, the part 1 is locked on the casing 2.

There is to be noted that the bolt 4 prevents the longer branch 1*b* to come out completely from the casing 2, during the handling that has just been described. It also prevents part 1 from rotating about the axis of the branch 1*b* when the shorter branch 1*a* is completely disengaged from the casing 2. It may be noted that in the key-holder described, the mechanism visible in FIG. 2 allows to adapt the size of the useful portion of the part 1 to the number of keys engaged on that part and that it provides for the locking of that part in the selected position. In an alternative, the longer branch 1*b* could have, in its portion extending beyond the free end of the shorter branch 1*a*, not only a single bolt 4, but a plurality of bolts spaced in the same manner as the notches or latch locks 14. Those bolts could be replaced by threads of a threading that could be provided on that portion of the branch 1*b*. The arrangement bolts on 1*b* and latch locks on 3 could obviously be inverted, that is to say bolts on 3 and latch locks on 1*b*.

In the case where the end of the longer 1*b* of the two branches of the part 1 would be threaded, the unlocking and the locking, after selecting the best size of ring according to the number of keys hooked, could be provided by a serrated wheel, offset or not, clamping the rod on the selected position. In the case where the end of the longer of the two branches is notched, the unlocking and the locking of the ring could also be provided by a pawl system.

In the form of execution according to FIG. 3, 3*a* and 4, the casing 7 has a flat circular shape; it is formed also of two symmetric portions 7*a*, 7*b*, made integral in a known manner. The member intended to receive the keys is a circular ring 5 extending on an angle of 340° approximately. This ring is provided to pivot, at one of its ends, at 12, inside the casing 7, whereas its opposite end may engage to a variable extent the casing when said ring is rotated about the pivot 12 (which is substantially offset with respect to the central area 8 from 7), its centre describing the arc of a circle 5*a*. The mechanism allowing the locking of the ring 5 in the position that has been selected in relation to the number of keys engaged therein is diagrammatically indicated in FIG. 4. It is arranged in the central area 8 of the casing 7 and comprises a flange 15*a* integral with the part 7*a*, a flange 15*b* integral with 7*b*, and a traction spring 16 arranged between those flanges and tending to bring them closer from each other. The free end of the ring passes between portions (not visible on the drawing) of the flanges 15*a*, 15*b*, which, under the action of the spring 16, press it between them. Those portions are preferably grooved or notched, to prevent a sliding of the ring between those portions of the flanges. The ring is then provided appropriately with grooves or one or a plurality of catches to cooperate with the grooves or notches of the flanges.

The operation of this second form of execution is as follows. To unlock the ring 5, it is sufficient with pressing on the central area of the portions 7*a*, 7*b* of the casing so as to bring them slightly closer to each other, thereby allowing the resilience of those portions. Consequently, the flanges 15*a*, 15*b* are slightly separated from each other, and the ring is free to rotate about the pivot 12, either to disengage its free end from the casing 7, or to engage that end more or less into the casing, according to the number of keys arranged on that ring. When the desired extent of depression is reached, it is only a matter of stopping the pressure on the portion between the parts 7*a*, 7*b*, so that the flanges 15*a*, 15*b* clamp therebetween the ring 5 and lock it in the casing.

The alternative according to FIG. 5 defers from the second form of execution simply by the fact that the ring 6 has an hyperbolic spiral shape instead of a circular shape. This ring 6 pivots at one of its extremities, inside the circular casing 7*a*, about an offset pivot 12*a*. The extremity of the spiral which thus pivots is the extremity of the starting or originating point of the spiral. The operation is the same as in the case of FIG. 3, 3*a*, 4.

The construction is provided with metal or hard plastic material, the ring and the casing being allowed to undergo various surface treatments or, optionally, to be decorated. The object of the present invention is to provide the user with a pocket or wall instrument, according to the versions, allowing the user to keep advantageously all the keys to be gathered, while eliminating the risk of losing them as a result of an inadvertent opening of the ring, and without hindering the manoeuvrability freedom of each of the keys owing to the possibility of adjustment of the ring size.

I claim:

1. Key-holder, comprising a casing (2, 7, 7*a*) and a ring (1, 5, 6) for receiving the keys, characterized in that the ring (1) is mounted movable on the casing (2) between an open position and various closed positions where its length outside the casing is adjustable between a maximum and a minimum, and in that it comprises a mechanism (3, 11, 14, 4 FIG. 2; 15*a*, 15*b*, 16) for locking the ring on the casing in the one of those closed positions where it has been brought and for which its portion outside of the casing has a length appropriate to the number of the keys received, the key ring (1) is formed by a U-shaped part having two parallel branches (1*a*, 1*b*) of unequal length adapted to slide in corresponding grooves (9*a*, 9*b*) of the casing (2).

2. Key-holder, comprising a casing (2, 7, 7*a*) and a ring (1, 5, 6) for receiving the keys, characterized in that the ring (1) is mounted movable on the casing (2) between an open position and various closed positions where its length outside the casing is adjustable between a maximum and a minimum, and in that it comprises a mechanism (3, 11, 14, 4 FIG. 2: 15*a*, 15*b*, 16 FIG. 4) for locking the ring on the casing in the one of those closed positions where it has been brought and for which its portin outside of the casing has a length appropriate to the number of the keys received; and wherein the key receiver ring (1) is formed by a U-shaped part of which the two branches (1*a*, 1*b*) are of parallel unequal lengths and are provided to slide in corresponding grooves (9*a*, 9*b*) of the casing (2); and further wherein the longer branch (1*b*) of the ring (1) has means (4) to cooperate with corresponding means of said mechanism (3, 11, 14, 4) so as to lock the ring (1) in a selected position, means (10, 11) being provided to temporarily unlock the ring (1) for its handling.

3. A key-ring comprising a housing (2), a rigid open ring (1) for receiving keys, the ends of which ring are designed for sliding in the housing, and a mechanism for locking said ring, said ring (1) for receiving keys consisting of a U-shaped element with two parallel branches (1*a*, 1*b*) of unequal length designed to both slide into corresponding grooves (9*a*, 9*b*) provided in the housing and said ring (1) being capable of moving between an open position where the shorter branch (1*a*) of the ring is desengaged from the housing and a plurality of closed positions, the longer branch (1*b*) of the ring (1) being provided with means (4) for cooperating with corresponding means of said mechanism (3, 11, 14, 4) in order to lock the ring (1), and means (10, 11) being provided for temporarily unlocking the ring when it is desired to move it, characterized in that the portion of the ring (1) which receives the keys and extends outside the housing can be adapted in its length to suit the number of keys engaged on the ring (1), in that a plurality of preselected locking positions are available at which different lengths of the two branches of the ring are engaged inside the housing, and in that the means of said locking mechanism (3, 11, 14, 4) are in their totality located inside a chamber (13) of the housing (2).

4. Key-holder according to claim 1, characterized in that the longer branch (1*b*) of the ring (1) has means (4) to cooperate with corresponding means of said mechanism (3, 11, 14, 4) so as to lock the ring (1) in a selected position, means (10, 11) being provided to temporarily unlock the ring (1) for its handling.

5. Key-holder according to claim 2, characterized in that the ring (5, 6) has an arcuated shape and is mounted on an eccentric pivot (12, 12*a*) in the casing (7, 7*a*) whereas its free end is engageable in the casing, the mechanism to lock the ring in a selected closed position comprising clamping members (15*a*, 15*b*) and a spring (16), the portion of the ring (5, 6) engaged into the casing (7, 7*a*) passing between those clamping members (15*a*, 15*b*) and the spring (16) biasing those members for clamping therebetween that portion of the ring to lock it up, means (7*a*, 7*b*) being provided to separate temporarily from each other those clamping members (15*a*, 15*b*).

6. Key-holder according to claim 5, characterized in that the clamping members (15*a*, 15*b*) are integral respectively with the bottom of one of the two symmetric parts (7*a*, 7*b*) forming the casing, those bottoms being flexible and resiliently deformable under the effect of a pressure exerted on the central portion thereof, the means for separating temporarily from each other the clamping members being comprised by those bottoms themselves.

7. Key-holder according to claim 5 or 6, characterized in that the ring (5) has a circular shape extending over more 340°.

8. Key-holder according to claim 5 or 6, characterized in that the ring (6) has a spiral shape, the eccentric pivot being located where the spiral originates.

* * * * *